US005395661A

United States Patent [19]

Mizunuma et al.

[11] Patent Number: 5,395,661

[45] Date of Patent: Mar. 7, 1995

[54] METHOD OF MANUFACTURING AN IMMERSION MEMBER WITH PORE-SEALING LAYER

[75] Inventors: Michiyoshi Mizunuma, Nagoya; Teruyuki Uchiyama, Tokai; Kiyohiro Tarumi, Nakatsu, all of Japan

[73] Assignee: Nippon Steel Hardfacing Co., Ltd., Tokyo, Japan

[21] Appl. No.: 94,145

[22] PCT Filed: Nov. 29, 1991

[86] PCT No.: PCT/JP91/01646

§ 371 Date: Aug. 16, 1993

§ 102(e) Date: Aug. 16, 1993

[87] PCT Pub. No.: WO92/07443

PCT Pub. Date: Apr. 30, 1992

[51] Int. Cl.[6] ..... B05D 1/08

[52] U.S. Cl. ..... 427/451; 427/450; 427/455; 427/456; 427/226; 427/453

[58] Field of Search ..... 427/450, 451, 453, 454, 427/455, 456, 226

[56] References Cited

U.S. PATENT DOCUMENTS 3,944,683 3/1976 Church et al. ..... 427/450

FOREIGN PATENT DOCUMENTS 3-94048 4/1991 Japan .

*Primary Examiner*—Shrive Beck
*Assistant Examiner*—Katherine A. Bareford
*Attorney, Agent, or Firm*—Kanesaka & Takeuchi

[57] ABSTRACT

A manufacturing method for immersion members for molten metal baths, wherein a thermal sprayed coating including 1–50 wt % of tungsten boride, 3–25 wt % of one or more of Ni, Co, Cr, and Mo as a metal phase, and a remainder including tungsten carbide, is formed on the surface of a immersion member for use in molten metal baths, and subsequently, impregnation processing is conducted with respect to the thermal sprayed coating in a processing fluid having as a main component thereof chromic acid ($H_2CrO_4$ and $H_2Cr_2O_7$), and subsequently, baking processing is conducted. In accordance with this manufacturing method, a surface layer possessing fine microstructure and high bond strength not conventionally available is provided, and it is possible to manufacture a superior immersion member for use in molten metal baths which has superior resistance to corrosion, resistance to corrosive peeling, and resistance to abrasion, and to which metals do not easily adhere.

9 Claims, No Drawings

METHOD OF MANUFACTURING AN IMMERSION MEMBER WITH PORE-SEALING LAYER

TECHNICAL FIELD

The present invention relates to a manufacturing method for immersion members immersed for a long period in a high temperature molten metal bath such as one of molten zinc, molten aluminum, molten tin, and the like. In particular, the present invention relates to a manufacturing method for immersion members for use in molten metal baths in molten zinc plating production lines, molten aluminum plating production lines, molten tin plating production lines, or the like; for example, sink rolls and support rolls which are used in an immersed state in a molten zinc plating bath or a molten aluminum plating bath.

BACKGROUND ART

It is apparent that a resistance to corrosion resulting from molten metals is in great demand with respect to immersion members which are used over a long period of time in an immersed state in high temperature molten metal baths such as one of molten zinc, molten aluminum, or molten tin, or the like. In particular, in sink rolls and support rolls, it has been desirable not merely that resistance to corrosion resulting from molten metals be present, but also that abrasion resulting from the contact between the roll and the substrate to be plated, such as a steel plate or the like, which is immersed in the bath, be unlikely to occur, and that adhesion of metals also be unlikely to occur.

When metal adhesion occurs on immersion rolls such as sink rolls, support rolls or the like, damage is caused to the substrate to be plated, or to the plating surface of the steel plate or the like, which is guided by these rolls and immersed in the bath. Furthermore, for this reason, immersion rolls such as sink rolls and support rolls have become unsuitable for use.

Conventionally, in response to these varying demands, immersion members having various cermet materials thermal sprayed thereon have been developed and used; however, such members are as yet insufficient. For example, a WC-Co cermet thermal sprayed coating is used as an immersion member for use in molten metal baths; however, such a member is insufficient from the point of view of molten metal corrosion resistance.

Furthermore, the above-described demands have become more and more increasing in concert with demands for increasing quality of plated products, demands for a reduction in manufacturing costs, and demands for extended service life of immersion rolls.

In response to these demands, the present inventors previously invented an immersion member for use in molten zinc baths and the like, in which the surface coating of the immersion member itself comprises one or more of tungsten carbides, tungsten borides, and molybdenum borides, in addition to Co, and this was disclosed in Japanese Patent Application Hei 1-231293 (Japanese Patent Application, Laid-Open No. Hei 3-94048, laid open date: Apr. 18, 1991). Corrosion resistance of the immersion member with respect to molten metal baths was achieved by means of this invention; however, there was a problem in that corrosive peeling occurred during use over a long period of time.

In general, cracks and micropores are present in a thermal sprayed coating. During use of an immersion member in a molten metal bath over a long period of time, the molten metal penetrates to the interior of the thermal sprayed layer through these cracks and micropores and breaks down the thermal sprayed coating, corroding this thermal sprayed coating from below the surface, so that a phenomenon is noted in which the thermal sprayed coating peels away. This is termed corrosive peeling.

In order to solve this problem, the present inventors tested immersion members in which the cracks and micropores present in the thermal sprayed coating are filled with coal tar; however, under the conditions of high temperature present in the molten metal baths, the organic substances present in the coal tar decomposed and became gassified, and for this reason, the quality of the thermal sprayed coating was deteriorated, so that an immersion member having a long service life could not be obtained. Furthermore, the gas produced by the decomposition of the organic substances in the molten metal bath produced undesirable effects.

Furthermore, in order to avoid this phenomenon, an attempt was made to subject the immersion member to heat processing immediately prior to use in the molten metal bath after filling the cracks and micropores of the thermal sprayed coating of the immersion member for use in molten metal baths with coal tar; however, gas was produced by the decomposition of the organic substances contained in the coal tar during heat processing, and for this reason, micropitting was produced, and the coal tar filling material itself was lost, so that the desirable properties could not be obtained.

DISCLOSURE OF THE INVENTION

In order to solve the problems described above, the present inventors have conducted extensive research as described above, and as a result of this research, the present invention has been made.

First, an important feature of the present invention is the addition, in the thermal sprayed coating composition, of tungsten borides (WB and the like), to produce a $Cr_2O_3$-$B_2O_3$ system glass in at least the cracks and micropores, by means of an oxidation reaction with $H_2CrO_4$, or the like, and to form a fine and strong thermal sprayed pore-sealing layer using this effect. In accordance with the present invention, it is possible to obtain a superior immersion member for use in molten metals which is provided with a fine and strong surface film layer not found in the conventional art.

Hereinbelow, the present invention will be explained in detail.

Conventionally, a WC-Co cermet was employed in immersion members for use in molten metal baths; however, as a result of the research of the present inventors, it was determined that, in addition to WC, WB is superior from the point of view of corrosion resistance in molten metal. Next, it was determined that WB has a higher coefficient of thermal expansion and that the resulting thermal sprayed coating has a stronger thermal shock resistance than that of WC. Furthermore, it was determined that in an oxidizing atmosphere, borides form $B_2O_3$ on the surface thereof, and that at high temperatures, a portion of this $B_2O_3$ is volatilized; however, a certain amount remains on the surface.

Furthermore, the present inventors have determined that it is possible to obtain a superior coating when a thermal spraying material consisting of a cermet in which WC and WB are combined with at least one of Ni, Co, Cr, and Mo to coat WC and WB with Ni, Co, or the like, or a thermal spraying material consisting of WC and WB which are agglomerated with at least one of Ni, Co, Cr, and Mo and are subjected to granulation, and is sintered in a neutral atmosphere, these materials being subjected to thermal spray by a high-velocity oxygen fuel gun method or a plasma spraying method. The coating contains unavoidable impurities.

Furthermore, WB-WC is superior to WC in molten metal wettability, so that adhesion is unlikely to occur with respect to, for example, molten zinc. However, it was discovered that when the amount of WB added becomes large, satisfactory thermal spraying becomes difficult in a standard atmosphere.

Accordingly, it is preferable that the limitation on the amount of WB contained in the thermal sprayed coating be set to less than 50 weight %. Furthermore, when the amount thereof is too small, the desired effects cannot be realized. Accordingly, the amount of WB contained should be within a range of 1–50 weight %. It is more preferable that the amount contained be within a range of 10–40 wt %. Instead of using 1–50 wt % of tungsten boride, the thermal sprayed coating may contain 1–49 wt % of tungsten boride and 1–30 wt % of one or more of chromium boride, molybdenum boride, zirconium boride and titanium boride, wherein the total amount of these metal borides is less than 50 wt %.

The reason for the addition of at least one of Ni, Co, Cr, and Mo as a metal phase is to increase resistance to peeling, and to increase hardness, so that superior layer may be obtained. The amount of at least one of Ni, Co, Cr, and Mo should preferably be within a range of 3–25 wt %. At amounts of less than 3 wt %, no cermet effects can be obtained. Furthermore, when the metal phase exceeds 25 wt %, the effect of adding ceramics which are WC, WB or the like is lost. If at least one of Cr and Mo is added in an amount of less than 15 wt %, it is possible to improve the molten metal corrosion resistance of the metal phase. It is therefore necessary to limit the total amount of Ni, Co, Cr, and Mo to less than 25 wt %.

The immersion member for use in molten metal baths is subjected to surface polishing after thermal spraying; in the manufacturing method of the present invention, it is possible to conduct final polishing after thermal spray coating, prior to processing fluid impregnation processing, or after baking processing. A strong acid solution in which chromic acid is included as a main component is used as the processing fluid. In order to conduct the impregnation of the processing fluid into the thermal sprayed coating, it is possible to immerse the member for use in molten metal baths and having formed thereon the thermal sprayed coating, into the processing fluid, or to brush the processing fluid onto the thermal sprayed coating formed on the surface of the member for use in molten metal baths. By means of the impregnation processing, the processing fluid penetrates the cracks and micropores, and it is thus possible to fill these cracks and micropores. Next, by means of the initial heating during baking, the chromic acid ($H_2CrO_4$ and $H_2Cr_2O_7$) present in the processing fluid within the cracks and micropores is converted to $CrO_3$ to fill these cracks and micropores results. The chromic acid solution is desiccated by means of the heating, and the moisture component thereof is removed; however, if heating is continued, in the vicinity of 200° C., $CrO_3$ (chromic acid anhydride) melts, and it is possible to conduct $CrO_3$ molten salt processing in the thermal sprayed coating. The thermal sprayed coating in contact with this is oxidized, and the $CrO_3$ is finely bonded with the thermal sprayed coating. That is to say, by means of the reaction using $CrO_3$, the $Cr_2O_3$ which is formed and the inner surfaces of the cracks and micropores are chemically bonded, and a fine ceramic-filled thermal sprayed coating is formed. The baking temperature should preferably be greater than 400° C., at which temperature $Cr_2O_3$ conversion can be sufficiently conducted, and less than 500° C.; at these temperatures, almost all $CrO_3$ is converted to $Cr_2O_3$.

Furthermore, it has been determined that the reason that the immersion member produced in accordance with the present invention exhibits superior corrosion resistance with respect to molten metals is that, after the impregnation processing with processing fluid and baking processing, the borides, such as WB and the like, which are present in the thermal sprayed coating are finely and strongly bound with $Cr_2O_3$.

In particular, in the present invention, the vitrification reaction of the $B_2O_3$ produced by the oxidation of the borides present in the thermal sprayed coating and the $CrO_3$ is important. That is to say, the vitrification of $B_2O_3$ begins at a temperature of approximately 300° C. during heating; however, at this temperature, $CrO_3$ becomes a molten oxide, and the vitrified $B_2O_3$ and the $CrO_3$, which has become a molten oxide, oxidize the surface of the thermal sprayed coating and the layer within the cracks and micropores, so that fine fusion occurs so as to produce a $CrO_3$-$Cr_2O_3$-$B_2O_3$ glass substance. Furthermore, when heating is continued and the temperature reaches a level above 400° C., the $CrO_3$ is converted to $Cr_2O_3$ and solidifies completely; however, the $B_2O_3$ component becomes softer, a portion thereof reacts with the $Cr_2O_3$ to become more finely bound thereto, and the cracks and micropores are filled. The melting point of $B_2O_3$ is approximately 450° C.

Accordingly, the combination of the thermal sprayed coating and the processing of the present invention should be termed "glass sealing", and the oxide bonds between the thermal sprayed coating and $CrO_3$, and the bond resulting from vitrification of $CrO_3$ and $B_2O_3$ produce combined function to provide a strong and complete crack-and-micropore-filling effect, as well as an effect of an increase in layer bonding, is exhibited. Furthermore, no volatilization or combustion of the moisture component or alcohol component occurs during the thermal reaction (in the present invention, a dehydration reaction occurs; however, the moisture component is removed prior to the formation of molten $CrO_3$), and there is no formation of micropitting during heating. For this reason, it is thought that a fine and strong surface layer can be formed.

Furthermore, heating to a temperature in excess of 500° C. produces strain or residual stress in immersion members for use in molten metal baths, so that such heating is not preferable.

As a result of the above, it is recommended that the heating temperature during baking processing be within a range of 400° C. to 500° C.

Furthermore, a strongly acidic fluid comprising primarily chromic acid is used as the impregnation processing fluid of the present invention; and the addition of $Na^+$ and $K^+$ ions may improve the permeability of this fluid and apply the solubility of the metallic oxides on the surface of the layer to $B_2O_3$, and a small amount of the salts thereof may be added. For example, a small amount of sodium hydroxide (NaOH) or potassium hydroxide (KOH) may be added.

Furthermore, it is possible to add sodium molybdate or ammonium molybdate, or both sodium molybdate and ammonium molybdate, to the processing fluid 3. By means of this, the vitrification described above is improved, and furthermore, as a result of the presence of $MoO_3$, it is possible to obtain a finer and stronger bonding and diminution effect of micropores and increasing fineness of layer's microstructures. This is thought that the components filling the cracks or micropores form a $Cr_2O_3$-$B_2O_3$-$MoO_3$-borate system compound (for example, $Na_2B_4O_7$).

Furthermore, it is also possible to blend a water-soluble coating agent; however, in this case, an oxidation reaction is carried out by means of chromic acid, so that such an agent should be blended immediately prior to the use thereof in the impregnation processing.

In order to increase the reliability of the coating and strengthening effects of the thermal sprayed coating resulting from the manufacturing method of the present invention, it is also possible to repeat the cycle of the processing fluid impregnation processing and baking processing two or more times.

BEST MODE FOR CARRYING OUT THE INVENTION

Hereinbelow, an embodiment of the present invention will be explained.

EMBODIMENT I

A plurality of metal plates conforming to American Iron and Steel Institute standard AISI 316 (corresponding to the JIS standard SUS 316) having a thickness of 5 mm, a width of 30 mm and a length of 100 mm was prepared, and on one side of each metal plate, a thermal sprayed coating was formed by means of a high velocity oxygen fuel gun method, and as shown in Table 1, metal plates having formed thereon thermal sprayed coating having the compositions a–k, o, p, q, and r were produced. The compositions of the thermal sprayed coating formed on the sample metal plate surfaces are shown in Table 1. The compositions having the reference letters a–k fulfill the conditions of the present invention. The compositions referenced o and p do not fulfill the conditions of the present invention and are presented as Comparative Examples. The sample metal plates referenced q and r are Conventional Examples corresponding to standard conventional products; they employ WC-Co system cermet thermal sprayed coating.

Next, as shown in Table 2, impregnation processing in processing fluid and baking processing were conducted on the sample metal plates prepared as described above, and a molten zinc bath immersion test was conducted. In concert with this, a molten zinc immersion test was conducted with respect to the sample metal plates which had not been subjected to impregnation processing in processing fluid or baking processing, and comparison was made with the examples of the present invention.

The plating bath employed in the test was a zinc aluminum (Zn-Al) plating bath containing 3% aluminum. In this test, each sample metal plate was continuously immersed in this plating bath, and the bath temperature was maintained at 500° C.; the state of the thermal sprayed coating of each sample metal plate was then visually evaluated. As a result of this evaluation, those plates which exhibited no corrosive peeling even after a period of 30 days of continuous immersion are indicated by the designation ◎, plates which exhibited no corrosive peeling after 10 days of continuous immersion but which exhibited corrosive peeling after 15 days of continuous immersion are indicated by the designation ○, while plates which exhibited corrosive peeling after a period of 10 days of continuous immersion are indicated by the designation Δ.

In Table 2, Examples 1–28 correspond to examples of the present invention, while Comparative Examples 31–42 are examples having thermal sprayed coating, identical to those of 1–28, which were not subjected to impregnation processing in the processing fluid or to baking processing. As is clear from the results shown in the Table, even immersion members possessing thermal sprayed coating having identical compositions did not have long service lives if not subjected to impregnation processing in the processing fluid and baking processing. Furthermore, even if impregnation processing in the processing fluid and baking processing were conducted with respect to immersion members having a conventional WC-Co cermet thermal sprayed coating formed thereon, satisfactory effects could not be obtained, as shown by Comparative Examples 45 and 46. Furthermore, as is clear from Comparative Examples 43 and 44, in cases in which the metal phase of the thermal sprayed coating was 2 wt % and 38 wt %, these examples were unacceptable in spite of the fact that WB was contained in an amount of 10 wt %. This was found to be so because, in the case in which the metal phase is too small, the ceramic material peels easily away from the thermal sprayed coating, while when the metal phase is too large, the metal phase is corroded by the molten metal.

From the above Examples,. Comparative Examples, and Conventional Examples, it was found that the effects of the present invention are great.

INDUSTRIAL APPLICABILITY

As stated above, the manufacturing method for immersion members for use in molten metal baths in accordance with the present invention is capable of producing immersion members for use in molten metal baths which possess corrosion resistance with respect to molten metals, have superior resistance to corrosive peeling, have superior resistance to abrasion, have a long service life, have superior wettability with respect to molten metals, and exhibit little metal adhesion, so that such members are extremely useful in industry.

TABLE 1

| | Composition of Thermal Sprayed Coating | | | | | | | | |
|---|---|---|---|---|---|---|---|---|---|
| | | Ceramic Composition (wt %) | | | | Metal-Phase Composition (wt %) | | | |
| | Reference | WB ($W_2B_5$) | $CrB_2$ | Other Borides | WC | Co | Ni | Mo | Cr |
| Used in Embodiments of Present Invention | a | 10 | — | — | Remainder | 10 | — | — | — |
| | b | 10 | — | MoB 3 | Remainder | 10 | — | 3 | — |
| | c | 20 | — | — | Remainder | — | 13 | — | — |
| | d | 20 | 5 | $ZrB_2$ 5 | Remainder | 12 | — | — | — |
| | e | 20 | — | $TiB_2$ 10 | Re- | 11 | — | — | 5 |

TABLE 1-continued

| Composition of Thermal Sprayed Coating | | | | | | | | |
|---|---|---|---|---|---|---|---|---|
| | Ceramic Composition (wt %) | | | | Metal-Phase Composition (wt %) | | | |
| Reference | WB ($W_2B_5$) | $CrB_2$ | Other Borides | WC | Co | Ni | Mo | Cr |
| | | | | maindER | | | | |
| f | 20 | — | MoB 25 | Remainder | 8 | — | 5 | — |
| g | 20 | — | — | Remainder | 5 | 7 | — | — |
| h | 30 | — | — | Remainder | 10 | 3 | 5 | — |
| i | 30 | 5 | — | Remainder | — | 12 | 3 | 5 |
| j | 30 | 5 | $TiB_2$ 5 | Remainder | 12 | 5 | 3 | — |
| k | 40 | — | — | Re- | 12 | — | — | — |

TABLE 1-continued

| Composition of Thermal Sprayed Coating | | | | | | | | |
|---|---|---|---|---|---|---|---|---|
| | Ceramic Composition (wt %) | | | | Metal-Phase Composition (wt %) | | | |
| | Reference | WB ($W_2B_5$) | $CrB_2$ | Other Borides | WC | Co | Ni | Mo | Cr |
| | | | | | maindER | | | | |
| Comparative Examples | o | 10 | — | — | Remainder | 2 | — | — | — |
| | p | 10 | — | — | Remainder | 35 | — | 3 | — |
| Conventional Examples | q | — | — | — | Remainder | 10 | — | — | — |
| | r | — | — | — | Remainder | 12 | — | — | 5 |

Note 1: Thermal spraying on one surface of an AISI316 sample having dimensions of 5 mm × 30 mm × 100 mm Note 2: In the Table, ($W_2B_5$) indicates that a small amount of $W_2B_5$ is contained in the WB.

TABLE 2

| No. | Thermal Sprayed Coating Composition (from Table 1) | Impregnation Processing Fluid | Baking Processing | Molten Zn Bath Immersion Test |
|---|---|---|---|---|
| Embodiments of Present Invention | | | | |
| 1 | a | 30% Chromic Acid | 450° C., Baking 30 minutes | ○ |
| 2 | a | 30% Chromic Acid, 2% Sodium Molybdate Mixture | 450° C., Baking 30 minutes | ○ |
| 3 | b | 30% Chromic Acid | 450° C., Baking 30 minutes | ○ |
| 4 | b | 30% Chromic Acid, 2% Sodium Molybdate Mixture | 450° C., Baking 30 minutes | ○ |
| 5 | c | 30% Chromic Acid | 450° C., Baking 30 minutes | ○ |
| 6 | c | 30% Chromic Acid, 2% Sodium Molybdate Mixture | 450° C., Baking 30 minutes | ○ |
| 7 | c | 30% Chromic Acid, 2% Ammonium Molybdate Mixture | 450° C., Baking 30 minutes | ○ |
| 8 | d | 30% Chromic Acid | 450° C., Baking 30 minutes | ○ |
| 9 | d | 30% Chromic Acid, 2% Sodium Molybdate Mixture | 450° C., Baking 30 minutes | ○ |
| 10 | e | 30% Chromic Acid | 450° C., Baking 30 minutes | ○ |
| 11 | e | 30% Chromic Acid, 2% Sodium Molybdate Mixture | 450° C. Baking 30 minutes | ○ |
| 12 | e | 30% Chromic Acid, 2% Sodium Molybdate, 2% Ammonium Molybdate Mixture | 450° C., Baking 30 minutes | ○ |
| 13 | f | 30% Chromic Acid | 450° C., Baking 30 minutes | ○ |
| 14 | f | 30% Chromic Acid, 2% Sodium Molybdate Mixture | 450° C. Baking 30 minutes | ○ |
| 15 | f | 30% Chromic Acid, 2% Ammonium Molybdate Mixture | 450° C., Baking 30 minutes | ○ |
| 16 | g | 30% Chromic Acid | 450° C., Baking 30 minutes | ○ |
| 17 | g | 30% Chromic Acid, 2% Sodium Molybdate Mixture | 450° C., Baking 30 minutes | ○ |
| 18 | g | 30% Chromic Acid, 2% Ammonium Molybdate Mixture | 450° C., Baking 30 minutes | ○ |
| 19 | g | 30% Chromic Acid, 2% Sodium Molybdate, 2% Ammonium Molybdate Mixture | 450° C., Baking 30 minutes | ○ |
| 20 | h | 30% Chromic Acid | 450° C., Baking 30 minutes | ○ |
| 21 | h | 30 Chromic Acid, 2% Sodium Molybdate Mixture | 450° C., Baking 30 minutes | ○ |
| 22 | i | 30% Chromic Acid | 450° C.. Baking | ○ |

TABLE 2-continued

| No. | Thermal Sprayed Coating Composition (from Table 1) | Impregnation Processing Fluid | Baking Processing | Molten Zn Bath Immersion Test |
|---|---|---|---|---|
| | | | 30 minutes | |
| 23 | i | 30% Chromic Acid, 2% Sodium Molybdate Mixture | 450° C., Baking 30 minutes | ○ |
| Embodiments of Present Invention | | | | |
| 24 | j | 30% Chromic Acid | 450° C., Baking 30 minutes | ○ |
| 25 | j | 30% Chromic Acid, 2% Sodium Molybdate Mixture | 450° C., Baking 30 minutes | ○ |
| 26 | k | 30% Chromic Acid | 450° C. Baking 30 minutes | ○ |
| 27 | k | 30% Chromic Acid, 2% Sodium Molybdate Mixture | 450° C., Baking 30 minutes | ○ |
| 28 | k | 30% Chromic Acid, 2% Ammonium Molybdate Mixture | 450° C., Baking 30 minutes | ○ |
| Comparative Examples | | | | |
| 31 | a | No Impregnation in Processing Fluid | No Baking Processing | |
| 32 | b | No Impregnation in Processing Fluid | No Baking Processing | |
| 33 | c | No Impregnation in Processing Fluid | No Baking Processing | |
| 34 | d | No Impregnation in Processing Fluid | No Baking Processing | |
| 35 | e | No Impregnation in Processing Fluid | No Baking Processing | |
| 36 | f | No Impregnation in Processing Fluid | No Baking Processing | |
| 37 | g | No Impregnation in Processing Fluid | No Baking Processing | |
| 38 | h | No Impregnation in Processing Fluid | No Baking Processing | |
| 39 | i | No Impregnation in Processing Fluid | No Baking Processing | |
| 41 | j | No Impregnation in Processing Fluid | No Baking Processing | |
| 42 | k | No Impregnation in Processing Fluid | No Baking Processing | |
| 43 | o | 30% Chromic Acid | 450° C., Baking 30 minutes | Δ |
| 44 | p | 30% Chromic Acid | 450° C., Baking 30 minutes | Δ |
| 45 | q | 30% Chromic Acid | 450° C., Baking 30 minutes | Δ |
| 46 | r | 30% Chromic Acid | 450° C., Baking 30 minutes | Δ |
| Conventional Examples | | | | |
| 51 | q | No Impregnation in Processing Fluid | No Baking Processing | Δ |
| 52 | r | No Impregnation in Processing Fluid | No Baking Processing | Δ |

Note 1: The evaluation of the zinc bath immersion test (molten Zn bath containing 3% Al, 500° C., an AISI 316 sample thermal sprayed on one surface and having dimensions of 5 mm × 30 mm × 100 mm) was as follows:
○: No corrosive peeling after 30 days' immersion
: No peeling after 10 days, corrosive peeling after 15 days' immersion
Δ: Corrosive peeling after 10 days' immersion

We claim:

1. A method of manufacturing an immersion member for use in a molten metal bath, comprising;

forming a thermal sprayed coating on the immersion member, said coating comprising 1–50 wt % of tungsten boride, 3–25 wt % of at least one of Ni, Co, Cr and Mo as a metal phase, and a remainder of tungsten carbide, impregnating a processing fluid containing chromic acid on said thermal sprayed coating to at least fill cracks and micropores on the thermal sprayed coating with said processing fluid, and baking said thermal sprayed coating with said processing fluid to produce a $Cr_2O_3$-$B_2O_3$ system glass in at least the cracks and micropores of the thermal sprayed coating to thereby form the immersion member without the cracks and micropores.

2. A method of manufacturing an immersion member according to claim 1, wherein said baking is conducted at a temperature between 400° and 500° C.

3. A method of manufacturing an immersion member according to claim 1, wherein said processing fluid contains at least one of ammonium molybdate and sodium molybdate.

4. A method of manufacturing an immersion member according to claim 1, wherein said thermal sprayed coating contains 10–40 wt % of tungsten boride.

5. A method of manufacturing an immersion member according to claim 1, wherein said coating consists essentially of 1–50 wt % of tungsten boride, 3–25 wt % of at least one of Ni, Co, Cr and Mo, and a remainder of tungsten carbide, 6. A method of manufacturing an immersion member for use in a molten metal bath, comprising;

forming a thermal sprayed coating on the immersion member, said coating comprising 1–49 wt % of tungsten boride; 1–30 wt % of at least one of chromium boride, molybdenum boride, zirconium boride and titanium boride, a total amount of said borides and tungsten boride being less than 50 wt %; 3–25 wt % of at least one of Ni, Co, Cr and Mo as a metal phase; and a remainder of tungsten carbide, impregnating a processing fluid containing chromic acid on said thermal sprayed coating to at least fill cracks and micropores of the thermal sprayed coating with said processing fluid, and baking said thermal sprayed coating with said processing fluid to produce a $Cr_2O_3$-$B_2O_3$ system glass in at least the cracks and micropores of the thermal sprayed coating to thereby form the immersion member without the cracks and micropores.

7. A method of manufacturing an immersion member according to claim 6, wherein said baking is conducted at a temperature between 400° and 500° C.

8. A method of manufacturing an immersion member according to claim 6, wherein said processing fluid contains at least one of ammonium molybdate and sodium molybdate.

9. A method of manufacturing an immersion member according to claim 6, wherein said thermal sprayed coating consists essentially of 1–49 wt % of tungsten boride; 1–30 wt % of at least one of chromium boride, molybdenum boride, zirconium boride and titanium boride, a total amount of said borides and tungsten boride being less than 50 wt %; 3–25 wt % of at least one of Ni, Co, Cr and Mo; and a remainder of tungsten carbide.

* * * * *